US009816169B2

(12) United States Patent
Xie

(10) Patent No.: US 9,816,169 B2
(45) Date of Patent: Nov. 14, 2017

(54) SUCKER ROD

(71) Applicant: Wei Xie, Surrey (CA)

(72) Inventor: Wei Xie, Surrey (CA)

( * ) Notice: Subject to any disclaimer, the term of this patent is extended or adjusted under 35 U.S.C. 154(b) by 342 days.

(21) Appl. No.: 14/711,368

(22) Filed: May 13, 2015

(65) Prior Publication Data

US 2016/0333645 A1 Nov. 17, 2016

(51) Int. Cl.

| | |
|---|---|
| ***C23C 4/06*** | (2016.01) |
| ***C23C 4/18*** | (2006.01) |
| ***E21B 17/10*** | (2006.01) |
| ***C23C 4/08*** | (2016.01) |

(52) U.S. Cl.

CPC ..... *C23C 4/06* (2013.01); *C23C 4/08* (2013.01); *C23C 4/18* (2013.01); *E21B 17/10* (2013.01)

(58) Field of Classification Search

CPC .. C23C 4/06; C23C 4/08; C23C 4/073; C23C 18/122; C23C 18/1834; C23C 18/1882; C23C 18/2066; E21B 17/10

See application file for complete search history.

(56) References Cited

U.S. PATENT DOCUMENTS 1,947,969 A * 2/1934 Browne ..... B23K 20/04 166/241.2
2,453,079 A * 11/1948 Rossmann ..... E21B 17/00 138/DIG. 5
2,690,934 A * 10/1954 Holcombe ..... E21B 17/003 138/145
2,725,264 A * 11/1955 Bodine, Jr. ..... E21B 17/1042 166/241.2
4,205,926 A * 6/1980 Carlson ..... E21B 17/00 166/68
4,406,561 A 9/1983 Ewing
5,069,284 A * 12/1991 Gray ..... E21B 17/1071 166/241.4
5,394,940 A * 3/1995 Durham ..... E21B 17/1071 156/295
6,027,583 A * 2/2000 Kretschmer ..... B23K 35/304 148/427
6,352,107 B1 * 3/2002 Bennett ..... E21B 17/00 166/105
2013/0316173 A1 11/2013 Moore
2016/0060968 A1 * 3/2016 Xie ..... E21B 17/00 403/361

OTHER PUBLICATIONS

Dictionary definitions of "casting" and "ferrule", accessed Jun. 14, 2017 via thefreedictionary.com.*
"Forging Manufacturing Defintions and Terms" entry for "biller", accessed Jun. 14, 2017 via www.engineersedge.com/Forging_definition.htm.*

* cited by examiner

*Primary Examiner* — Blake E Michener
(74) *Attorney, Agent, or Firm* — Alphabetica Law

(57) ABSTRACT

A sucker rod for use in oil well production and a method for making the sucker rod are disclosed. The sucker rod comprises two end portions and a rod body between the two end portions. Each end portion comprises an end section, a shoulder section, a tool engagement section and a tapered enlargement section. The shoulder section, the tool engagement section and the tapered enlargement section are coated by an alloy coating (such as a corrosion-resistant Ni-based alloy). The rod body is coated by a non-metal coating (such as a corrosion-resistant polymer coating).

14 Claims, 3 Drawing Sheets

SUCKER ROD

TECHNICAL FIELD

The present invention relates in general to sucker rods for use in oil wells and other wells, and to methods for making the sucker rods.

BACKGROUND

Oil is removed from the ground using a pump-jack. This equipment is mounted on the surface of the earth above an oil reservoir. The pump-jack is connected to a down-hole pump located at the bottom of an oil well by a string of interconnected sucker rods, which extends inside a production tubing. Through the action of the pump-jack, oil is pumped from the reservoir to the surface for collection.

A sucker rod is typically a rod having a length of between 24 and 32 feet and a diameter of 0.5 to 2 inches. During pumping, the string of sucker rods performs a reciprocating or alternative movement, which may produce deflections of the string. The sucker rods are thereby subjected to wear due to frictional contact with the inner wall of the production tubing. Even though the fluid environment serves as a lubricant, abrasion does occur over the surface of the sucker rods. Additionally, tools used for assembling sucker rods into a string may also cause tearing of the rod surface.

In some oil wells, the fluid includes dissolved salts and undissolved minerals which may have an additional abrasive or corrosive effect on the sucker rod surface. The presence of hydrogen sulfide ($H_2S$), sulfurs (HS, S), water, salty water, hydrogen ions, $CO_2$ in aqueous solution, and other corrosive chemical compounds, also weaken the sucker rods structure, thereby reducing their fatigue limit. When the attack is particularly harsh, sucker rods break.

When a rod fails, the whole sucker rod string needs to be pulled from the well and inspected, and defective rods must be replaced. This procedure increases costs when it becomes frequent. Additional costs related to corrosion problems result in losses in production, added costs for new materials, and increased pulling costs.

Therefore, it is desirable to provide a sucker rod capable of reducing friction and/or resisting corrosion in environments like those found in oil wells.

BRIEF DESCRIPTION OF DRAWINGS

In drawings which show non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
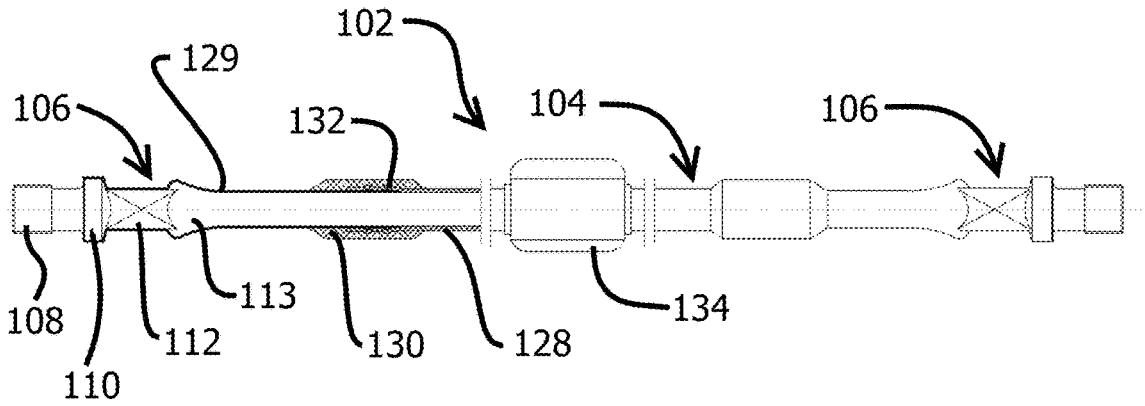
FIG. 1 shows a sucker rod according to an example embodiment of the invention.
Figure 2:
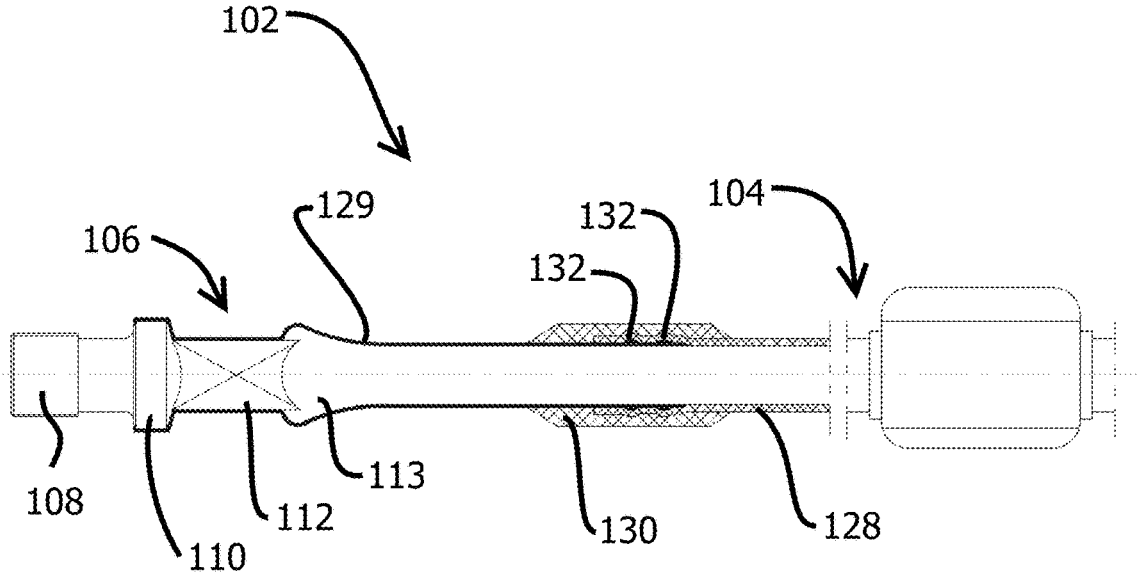
FIG. 2 is an enlarged view of a portion of the sucker rod of FIG. 1.

One aspect of the invention relates to sucker rods. FIG. 1 shows a sucker rod 102 according to an example embodiment of the present invention. Sucker rod 102 comprises a rod body 104 and two end portions 106. In some embodiments, sucker rod 102 has a length in the range of 24 to 32 feet, and a diameter of 0.5 to 2 inches. FIG. 2 is an enlarged view of a portion of sucker rod 102 to more clearly show some details of sucker rod 102. The break lines in FIG. 1 (and also FIG. 2) indicate that rod body 104 may comprise a portion between the break lines which is not shown in order to shorten the view. The portions of sucker rod 102 to the left of the left break lines are shown in a partially sectional view. The sectional view is to better show the coating layer(s) on sucker rod 102. The other portions of sucker rod 102 are shown in a side elevation view.

Each end portion 106 comprises a male end section 108, a shoulder section 110, a tool engagement section 112, and a tapered enlargement section 113. Male end section 108 may be connectable to a coupling (which is a tubular connector typically having internal threads used to join two sucker rods together) or some other connector component. Male end section 108 may be threaded. Shoulder section 110 comprises an abutment face. When the sucker rod is connected to a coupling, the abutment face of the shoulder section abuts a face of the coupling. Tool engagement section 112 comprises a set of flats suitable for engagement by a sucker rod turning or holding tool (e.g., power tongs or wrench) used for turning a sucker rod or holding a sucker rod still when assembling sucker rods into a string. Tapered enlargement section 113 can be gripped by a lifting tool such as a sucker rod hanger or a sucker rod elevator, which is used to lift a sucker rod.

Sucker rods 102 can be assembled into a string of interconnected sucker rods by using couplings and/or other connector components. Some example couplings and/or connector components are described and illustrated in the Applicant's U.S. patent application Ser. No. 14/473,613, which is hereby incorporated by reference. The coupling may be a tubular connector having internal threads. The coupling may have two female end sections, with each female end section at one end. In use, the coupling can be connected to the male end sections of two adjacent sucker rods, thereby joining two sucker rods together. When pluralities of sucker rods and couplings are assembled into a string, the string may have the repeating pattern of: coupling, sucker rod, coupling, sucker rod, and so on.

The external surface of sucker rod 102 may comprise a corrosion-resistant non-metal coating 128 and a corrosion-resistant alloy coating 129. The entire external surface of sucker rod 102, except for the two male end sections 108, may be covered by coating 128 and 129.

Non-metal coating 128 may cover rod body 104 or a substantial portion of rod body 104, whereas alloy coating 129 may cover shoulder section 110, tool engagement section 112 and tapered enlargement section 113 of end portions 106. Alloy coating 129 may extend to rod body 104 to cover a portion of rod body 104. In some embodiments, alloy coating 129 extends from shoulder section 110 toward rod body 104, and the length of alloy coating 129 along the longitudinal direction may be 250-500 mm. In some embodiments, the length of alloy coating 129 may be shorter than 250 mm, or longer than 500 mm.

It is desirable for alloy coating 129 to cover shoulder section 110, tool engagement section 112 and tapered enlargement section 113, because these sections are subject to frictional contact with various sucker rod handling tools, and alloy coating 129 can protect these sections from physical wear and tear. At the same time, alloy coating 129 should not extend too much into rod body 104, because alloy coating 129 is usually a more expensive material than non-metal coating 128. Additionally, the production and processing costs of applying alloy coating 129 to sucker rod 102 are higher than the production and processing costs of applying non-metal coating 128.

As is more clearly shown in FIG. 2, there is an overlap region on rod body 104 where non-metal coating 128 overlaps with alloy coating 129. As shown in FIG. 2, in the overlap region, the non-metal coating layer is immediately above the alloy coating layer. As will be explained later, in the manufacturing process, the alloy coating is usually applied to the sucker rod first, followed by the non-metal coating. Therefore, in the finished sucker rod product, the non-metal coating layer is above the alloy coating layer in the overlap region.

As shown in FIGS. 1 and 2, at the overlap region there is a ferrule 130. Ferrule 130 is a ring-like or bracelet-like structure that wraps around and compresses the overlap region. Ferrule 130 has at least two functions. One function of ferrule 130 is to compress non-metal coating 128 against alloy coating 129 to provide a better seal in the overlap region, to prevent any abrasive or corrosive agent from getting under either non-metal coating 128 or alloy coating 129. The other function of ferrule 130 is to partially protect non-metal coating 128 from physical damage during use or assembly of sucker rod 102.

In some embodiments, alloy coating 129 has a thickness in the range of less than 1.0 mm. In some embodiments, alloy coating 129 has a thickness in the range of 0.2 to 0.5 mm. In the overlap region, alloy coating 129 may have one or more raised sections 132, wherein the thickness of the one or more raised sections is greater than the rest of alloy coating 129. For example, raised sections 132 may be 0.1 to 2.0 mm thicker than the rest of alloy coating 129. Raised sections 132 of alloy coating 129 may provide a number of advantages. For example, raised sections 132 provide a better seal to prevent abrasive or corrosive agents from getting under non-metal coating 128 or alloy coating 129. Additionally, raised sections 132 prevent movement in the longitudinal direction of ferrule 130 (or a centralizer, which will be described later) or non-metal coating 128.

In the manufacturing process, alloy coating 129 may be applied to sucker rod 102 using a suitable coating process, such as spraying. For example, alloy coating 129 may be applied to sucker rod 102 using thermal spraying. Alternatively, alloy coating 129 may be applied to sucker rod 102 using some other suitable coating methods.

Alloy coating 129 may comprise a superalloy material characterized by high resistance to wear and corrosion. Superalloy is an alloy that usually comprises one or more of Fe, Ni, Co, and Cr. In some embodiments, alloy coating 129 comprises a Ni-based alloy. In some embodiments, alloy coating 129 comprises a Co-based alloy. In some embodiments, alloy coating 129 comprises a Fe-based alloy. In some example embodiments, the percentage of Ni by weight in the Ni-based alloy may be more than 50%, or more than 60%, or more than 70%. In some example embodiments, the percentage of Cr by weight in the Ni-based alloy may be in the range of 5% to 20%, or 10% to 15%. In some example embodiments, the Ni-based alloy for alloy coating 129 may comprise in percentage by weight 70-80% Ni, 10-15% Cr, 0-8% Fe, 0.2-0.4% C, 3.0-4.5% B, 0-0.02% P, 0-0.02% S.

Non-metal coating 128 may comprise a friction-resistant polymeric material. The polymeric material of non-metal coating 128 may be a polymeric material comprising either a thermoplastic material or a thermoset material or both. Coating 128 may be formed of co-polymers, homo-polymers, composite polymers, or co-extruded composite polymers. The term "co-polymers" refers to materials formed by mixing two or more polymers, "homo-polymers" refers to materials formed from a single polymer, and "composite polymers" refers to materials formed of two or more discrete polymer layers that can either be permanently bonded or fused.

In some embodiments, coating 128 may comprise polyethylene. For example, coating 128 may comprise high-density polyethylene (HDPE) or cross-linked polyethylene (PEX). Polyethylene in general has several advantages over other materials such as polyurethane. For example, polyethylene has a lower coefficient of friction than polyurethane, it is easier to manufacture, it is easier to recycle than thermoplastic polyurethane, and it is less costly.

In some embodiments, coating 128 may comprise high-strength resin material. In some embodiments, coating 128 may comprise polyvinylidene fluoride (PVDF), ethylene tetrafluoroethylene (ETFE), polytetrafluoroethylene (PTFE), polyphenylensulfide (PPS), polyamide, polyester, polyethersulfone, polyethylene terephthalate (PET), polypropylene, polystyrene, epoxy, or a combination thereof.

Sucker rod 102 may also comprise one or more centralizers 134 which are interspaced along the length of rod body 104 of sucker rod 102. Each centralizer 134 encircles rod body 104 of sucker rod 102. The function of centralizers 134 is to centralize sucker rods 102 within a production tubing and to reduce frictional forces between the production tubing and sucker rods 102.

Figure 3:
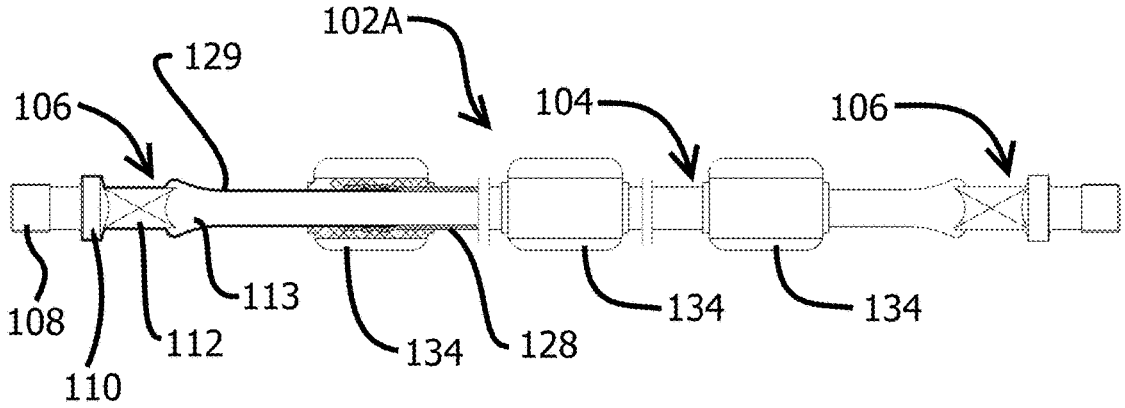
FIG. 3 shows a sucker rod according to another example embodiment of the invention.

FIG. 3 shows a sucker rod 102A according to another example embodiment of the present invention. Sucker rod 102A may comprise some or all of the features of sucker rod 102 as described above. One difference between sucker rod 102A (shown in FIG. 3) and sucker rod 102 (shown in FIG. 1) is that ferrule 130 in sucker rod 102 is replaced by a centralizer 134 in sucker rod 102A. In sucker rod 102A, centralizer 134 may provide similar functions as ferrule 130. One function of centralizer 134 (the one that covers the overlap region where non-metal coating 128 overlaps alloy coating 129) is to compress non-metal coating 128 against alloy coating 129 to provide a better seal in the overlap region, to prevent any abrasive or corrosive agents from getting under either non-metal coating 128 or alloy coating 129. The other function of centralizer 134 is to partially protect non-metal coating 128 from physical damage during use or assembly of sucker rod 102.

The sucker rods of the present disclosure have a number of advantages. For example, the tool engagement sections and tapered enlargement sections of the sucker rod are covered by the alloy coating. These sections receive a lot of pushing, pressing, shoving and frictional contact in use, as they are contacted by sucker rod turning tool (e.g., power tongs or wrench) or sucker rod lifting tools (e.g., sucker rod hanger or sucker rod elevator). The alloy coating protects the tool engagement sections and tapered enlargement sections of the sucker rod from physical damage and wear and tear. With the alloy coating, the tool engagement sections and tapered enlargement sections of the sucker rod can be handled with conventional sucker rod handling tools, without using any extra special handling tools or protecting tools to protect these sections. Additionally, the alloy coating protects the end portions of the sucker rods from abrasive or corrosive agents that are present in oil production environment.

Another advantage of the sucker rods of the present disclosure is that only the end portions of the sucker rods are coating with the alloy coating, which is a relatively expensive material. The rest of the sucker rod (i.e., the rod body between the two end portions) is coated using a corrosion-resistant non-metal coating, which is a relatively less expensive material. The rod body generally does not receive as much physical pushing, pressing, shoving or frictional contact by sucker rod handling tools as the end portions. Therefore, the non-metal coating provides a cost-effective way to protect the rod body of the sucker rod and at the same time shield the rod body from abrasive or corrosive agents. Additionally, the process of applying the non-metal coating to the sucker rod is generally less costly and requires less skill for the workers than the process of applying the alloy coating to the sucker rod.

One aspect of the invention relates to methods of making a sucker rod, for example, a sucker rod as disclosed in the present disclosure. In some embodiments, the method comprises (1) producing an uncoated sucker rod using a forging process, (2) cleaning the external surface of the sucker rod, (3) coating end portions (excluding male end sections) of the sucker rod with a first coating material, said first coating material being an alloy, (4) generating threading on the male end sections of the sucker rod, (5) cleaning the external surface of the sucker rod, (6) coating the rod body of the sucker rod with a second coating material, said second coating material being a non-metal (e.g., a polymer), and (7) adding one or more ferrules or centralizers to the sucker rod using a pressure casting process.

In some embodiments, in step (3) of the manufacturing process, the first coating material is applied on the sucker rod using a thermal spraying process. In some embodiments, the second coating material is coated on the sucker rod such that the second coating layer partially overlaps the first coating layer. The ferrule or centralizer may be added to the sucker rod to cover the overlap region where the second coating layer overlaps the first coating layer.

In some embodiments, the first coating (i.e., the alloy coating) has a generally uniform thickness. In some embodiments, the thermal spraying process creates one or more raised sections in the first coating having an increased thickness. As mentioned before, the one or more raised sections of the first coating provide a better seal to prevent abrasive or corrosive agents from getting under the coating and also prevent undesired movement of the ferrule, the centralizer, or the non-metal coating along the longitudinal direction.

As will be apparent to those skilled in the art in the light of the foregoing disclosure, many alterations and modifications are possible in the practice of this invention. The scope of the claims should not be limited by the preferred embodiments set forth in the examples, but should be given the broadest interpretation consistent with the description as a whole.

What is claimed is:

1. A sucker rod comprising:

two end portions and a rod body between the two end portions, wherein each end portion comprises an end section, a shoulder section, a tool engagement section and a tapered enlargement section, wherein the shoulder section, the tool engagement section and the tapered enlargement section are coated by an alloy coating, and wherein the rod body is coated by a non-metal coating, and wherein the alloy coating extends to the rod body to overlap with the non-metal coating at an overlap region on the rod body, wherein the alloy coating comprises one or more annular raised sections at the overlap region, the raised sections having an increased thickness than the rest of the alloy coating.

2. The sucker rod according to claim 1, wherein the alloy coating is resistant to wear and corrosion.

3. The sucker rod according to claim 2, wherein the alloy coating comprises a Ni-based alloy, a Co-based alloy, or a Fe-based alloy.

4. The sucker rod according to claim 3, wherein the alloy coating comprises a Ni-based alloy.

5. The sucker rod according to claim 4, wherein the Ni-based alloy comprises greater than 70% Ni by weight.

6. The sucker rod according to claim 5, wherein the Ni-based alloy comprises 5-20% Cr by weight.

7. The sucker rod according to claim 1, wherein the non-metal coating comprises a corrosion-resistant polymer coating.

8. The sucker rod according to claim 7, wherein the corrosion-resistant polymer coating comprises polyethylene.

9. The sucker rod according to claim 7, wherein the corrosion-resistant polymer coating comprises high-density polyethylene (HDPE) or cross-linked polyethylene (PEX).

10. The sucker rod according to claim 1, comprising one or more ferrules which cover the overlap regions on the rod body.

11. The sucker rod according to claim 1, comprising one or more centralizers which cover the overlap regions on the rod body.

12. The sucker rod according to claim 1, comprising one or more ferrules and one or more centralizers interspaced along the length of the rod body.

13. A method for making the sucker rod as defined in claim 1, the method comprising: (1) producing an uncoated sucker rod using a forging process, (2) coating the end portions (excluding the end sections) of the sucker rod with a first coating material, said first coating material being an alloy, and (3) coating the rod body of the sucker rod with a second coating material, said second coating material being a non-metal, and wherein the first coating material is applied on the sucker rod using a thermal spraying process, and wherein the thermal spraying process generates one or more annular raised sections in the first coating.

14. The method according to claim 13, further comprising the step of adding one or more ferrules or one or more centralizers to the sucker rod using a pressure casting process.

* * * * *